US006131862A

United States Patent [19]

Gruenenfelder

[11] Patent Number: 6,131,862

[45] **Date of Patent: *Oct. 17, 2000**

[54] ERGONOMIC SUPPORT SYSTEM

[76] Inventor: Marc A. Gruenenfelder, 220 A1 Harvey Rd., Stonington, Conn. 06378

[ * ] Notice: This patent is subject to a terminal disclaimer.

[21] Appl. No.: 09/158,586

[22] Filed: Sep. 22, 1998

Related U.S. Application Data

[63] Continuation-in-part of application No. 08/909,835, Aug. 12, 1997, Pat. No. 5,884,879.

[51] Int. Cl.[7] ..... B86G 5/00

[52] U.S. Cl. ..... 248/118; 248/918

[58] Field of Search ..... 248/118, 118.1, 248/118.3, 118.5, 918, 911; 400/715, 718; D14/114; 108/69, 91

[56] References Cited

U.S. PATENT DOCUMENTS

| | | | |
|---|---|---|---|
| 744,287 | 11/1903 | Brasel . | |
| 3,300,250 | 1/1967 | Dollgener et al. | 248/118.1 |
| 4,650,141 | 3/1987 | Longo et al. | 248/118 |
| 5,125,606 | 6/1992 | Cassano et al. | 248/118 |
| 5,131,614 | 7/1992 | Garcia et al. | 248/118 |
| 5,163,646 | 11/1992 | Engelhardt | 248/118 |
| 5,170,971 | 12/1992 | Schaeffer et al. | 248/118.1 |
| 5,195,705 | 3/1993 | Kline et al. | 248/118.3 |
| 5,342,005 | 8/1994 | Szmanda | 248/118 |
| 5,467,950 | 11/1995 | Dumitru | 248/118.1 |
| 5,492,298 | 2/1996 | Walker | 248/346.01 |
| 5,513,824 | 5/1996 | Leavitt | 248/118.3 |
| 5,590,430 | 1/1997 | Sereboff | 5/655.5 |
| 5,597,218 | 1/1997 | Lechman | 312/223.3 |
| 5,628,483 | 5/1997 | Smith et al. | 248/118 |
| 5,826,841 | 10/1998 | Lavore | 248/118 |
| 5,884,879 | 3/1999 | Gruenenfelder | 248/118 |

OTHER PUBLICATIONS

Materials Summary Sheet, CONFOR Foams, E–A–R Specialty Composites Div., Cabot Safety Corporation, one sheet (both sides), printed Feb. 1996.

Technical Data Sheet TDS–13, CONFOR Ergonomic Urethane Foams, E–A–R Specialty Composites Division, Cabor Safety Corporation, faxed Jul. 18, 1996, 5 sheets.

*Primary Examiner*—Ramon O. Ramirez
*Assistant Examiner*—Gwendolyn Baxter
*Attorney, Agent, or Firm*—Albert W. Hilburger

[57] ABSTRACT

An ergonomic support system for receiving supporting the forearm and/or wrist of a person engaged in an activity on a supporting surface comprises a support member of plastic foam material extending longitudinally and laterally and having a bottom surface for resting on the supporting surface, a top surface adapted for receiving the forearm and/or wrist of the person, a transverse dimension as measured between the top surface and the bottom surface, and a peripheral surface extending between the top surface and the bottom surface. The support member exhibits a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C. The support member has a total thickness in the approximate range of one to two inches. An outer covering of substantially taut flexible material envelops the support member contiguous to the bottom, top, and peripheral surfaces to restrain against longitudinal and lateral displacement of the plastic foam material when applying a transverse force to the support member.

25 Claims, 6 Drawing Sheets

ERGONOMIC SUPPORT SYSTEM

This is a continuation-in-part of U.S. patent application Ser. No. 08/909,835 filed Aug. 12, 1997 now U.S. Pat. No. 5,884,879 and entitled "Ergonomic Support Pad", the entire disclosure of which is incorporated herein by reference.

BACKGROUND OF THE INVENTION

1. Field of the Invention

The present invention relates generally to ergonomic support systems for receiving and supporting the forearm and/or wrist of a person engaged in an activity on a supporting surface. It may apply to the field of computer accessories and peripheral equipment for use by computer operators and, more particularly, to an ergonomic support system for receiving and supporting the forearm and/or wrist of a person operating an input-output device for a computer such as a keyboard or a mouse.

2. Description of the Prior Art

Numerous appliances are known which are pertinent to the invention at hand. One early instance is presented in U.S. Pat. No. 3,300,250 issued Jan. 24, 1967 to Dollgener et al. which discloses a cushioned arm rest for individuals whose occupations require a continuous use of their hands along the depending edge of work tables, benches, desks and the like.

U.S. Pat. No. 5,170,971 issued Dec. 15, 1992 to Schaeffer et al. discloses a wrist supporter made of polyurethane foam having an L-shape cross section which is adapted for installation along an edge of a work surface.

U.S. Pat. No. 5,195,705 issued Mar. 23, 1993 to Kline et al. discloses a microscope stand and armrest system for placement on a conventional desktop. Height adjustment and leveling feet are provided at each corner of a base plate and a top surface is hinged to the base plate for receiving a microscope and for tilting the microscope rearward toward the user to a position that allows the user to look directly forward when operating the microscope. Left and right sloping armrests which may be of polyurethane foam material are provided for placement on the desktop at each side of the microscope stand to support the user's forearms in natural positions while operating the microscope.

U.S. Pat. No. 5,342,005 issued Aug. 30, 1994 to Szmanda et al. discloses a forearm support apparatus for a keyboard operator which utilizes first and second forearm support units, each including a relatively firm base member having a tapered wall and a flat bottom wall. A complementing upper member has a similar taper and is secured to upper wall and an inverse orientation to raise the tapered wall to a top surface. The top member is formed of a highly resilient compressible material to receive the forearm which depresses the material and supports the forearm. The support units are mounted in laterally spaced relation with the tapered upper walls extending inwardly and downwardly toward each other such that the forearms are biased inwardly toward each other to restrict outward displacement. The members are formed symmetrically about a transverse plane generally parallel to the keyboard.

U.S. Pat. No. 5,492,298 issued Feb. 20, 1996 to Walker discloses an inclined mouse pad configured as a wedge, preferably molded of dense neoprene or the like, and equipped with working and decorative surfaces. When not in use, the working surface can be oriented downwardly against a table to expose the non-working surfaces to view. This protects the working surface from dust and damage from dropped objects and spills. The inclined mouse pad provides a gravity gradient in one direction, preferably the "Y" direction to give normal physiological feed back on the position of the mouse on the pad. Other advantages include ergonomic compatibility, elevation of the arm, and better control since the user pushes upward and pulls the mouse downward.

U.S. Pat. No. 5,597,218 issued Jan. 28, 1997 to Lechman discloses a wedge-like structure which is interposable between an object and its supporting substrate surface and whose thickness is adjustable for purposes of adjusting the tilt angle of the object relative to the substrate surface. The structure is comprised of a stack of generally flattened component members wherein a layer of a releasable adhesive composition is located between and bonded to adjacent component members that can have various configurations and be of a variety of compositions including rigid organic polymer foam. The wedgelike structure is said to be particularly well adapted for incorporation into a monitor support assembly that is located under a transparent window in the top portion of a work station so that the monitor tilt angle is adjustable relative to the assembly by the wedge-like structure.

More recently, in the aforementioned U.S. application Ser. No. 08/909,835, applicant herein disclosed a unique ergonomic support pad construction for supporting the forearm and wrist of a person operating a computer's input-output device. It was explained that the support pad may comprise bottom, middle, and top layers of open celled polyurethane foam material of substantially uniform thickness, preferably of the type which softens on contact with a warm surface thereby providing uniform pressure distribution and firm, yet fluid, support. The bottom layer has a bottom surface for resting on a supporting surface and the top layer has a top surface for engageably receiving the forearm and wrist of the person. Each layer exhibits different indentation force deflections, the bottom layer being firmest and the top layer being most supple. The support pad is approximately one to two inches thick, preferably four sided, and may be round or oval or of other shapes as viewed in plan. When multi-sided, it may have biased corner surfaces joining adjoining pairs of longitudinal and lateral edge surfaces. Longitudinal and lateral edge surfaces of the top layer are substantially perpendicular to the top surface and longitudinal and lateral edge surfaces of the middle and bottom layers are respectively uniformly angularly disposed with respect to the bottom surface, the bottom surface area being smaller than the top surface area. The combined thicknesses of said bottom and middle layers may be approximately equal to the thickness of the top layer. The support pad may have only two layers or more than three layers and may also be of one or more layers with each layer exhibiting a continuous gradient of values of indentation force deflections. That disclosure further explained that in a typical application, the foam may be graded so that the bottom layer exhibits an indentation force deflection, as measured by ASTM D3574 Test B1, which is in the approximate range of 488 lbf @10° C., 27 lbf @21° C. and 9 lbf @38° C., so that the middle layer exhibits an indentation force deflection in the approximate range of 315 lbf @10° C., 10 lbf @21° C. and 7 lbf @38° C., and so that the top layer exhibits an indentation force deflection in the approximate range of 34 lbf @10° C., 4 lbf @21° C. and 3 lbf @38° C.

A suitable material for purposes of that invention, and continuing for the present invention, is a product manufactured under the name of CONFOR™ Ergonomic Urethane Foams by E•A•R Specialty Composites Division Cabot Safety Corporation of Indianapolis, Ind. The indentation force deflection gradient can be applied to a range of products for light, medium and heavy weight users. A general shape of the support pad is square, but it may be made to other various shapes to accommodate designers. The pad is preferably flat on the top surface, but it could also be sculpted.

It was with knowledge of the foregoing disclosures representative of the state of the art that the present invention was conceived and has now been reduced to practice. Indeed, the intent of the present disclosure is to more intently focus on an inventive concept first presented in the applicant's co-pending application, aforesaid, that " . . . the pad may have a continuous . . . indentation force deflection gradient from top to bottom". This gradient may be zero and this concept will be expounded upon below.

SUMMARY OF THE INVENTION

An ergonomic support system for receiving and supporting the forearm and/or wrist of a person engaged in an activity on a supporting surface comprises a support member of plastic foam material extending longitudinally and laterally and having a bottom surface for resting on the supporting surface, a top surface adapted for receiving the forearm and/or wrist of the person, a transverse dimension as measured between the top surface and the bottom surface, and a peripheral surface extending between the top surface and the bottom surface. The support member exhibits a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C. The support member has a total thickness in the approximate range of one to two inches. An outer covering of substantially taut flexible material envelops the support member contiguous to the bottom, top, and peripheral surfaces to restrain against longitudinal and lateral displacement of the plastic foam material when applying a force transverse to the support member.

The combined thickness of the support system may be in the range of approximately one inch to two inches, the specific dimension being chosen for each intended use to achieve an optimum overall design. Features of the invention include the following:

- during use, the support system may be deformed to allow use in small places and actually wrap around the edge of the desktop or other supporting surface to provide easy use from any desk or computer stand;
- the support system may be provided with non-skid characteristics to hold it stationary during use;
- the plastic foam material of the support system readily deforms to accommodate the shape of the wrist or forearm of substantially any size person, within reason;
- the support system makes the use of a mouse or other computer input-output device a comfortable, relaxing experience, allowing the user to operate the mouse or other input-output device for many hours at a time without suffering from wrist fatigue;
- the user can actually feel comfortable while using the support pad so that less productive time will be wasted resting; and
- an improved level of fine control of the mouse movement or that of other input-output device and button clicking is achieved by the accommodating action of the top layer of the plastic foam material.

A particularly desirable feature of the invention resides in the combination of (i) open celled polyurethane material of the type which softens on contact with a warm surface thereby providing uniform pressure distribution and firm, yet fluid, support of the person's arm and wrist and (ii) an outer covering of substantially taut flexible material enveloping the support member contiguous to the bottom, top, and peripheral surfaces to restrain against longitudinal and lateral displacement of the plastic foam material when applying a transverse force to the support system. The outer covering is aesthetically pleasing, provides protection from the somewhat fragile foam member, provides a modicum of absorption of surface body fluids on the wrist and/or forearm of the user, and provides for heat distribution away from the wrist and/or forearm of the user.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
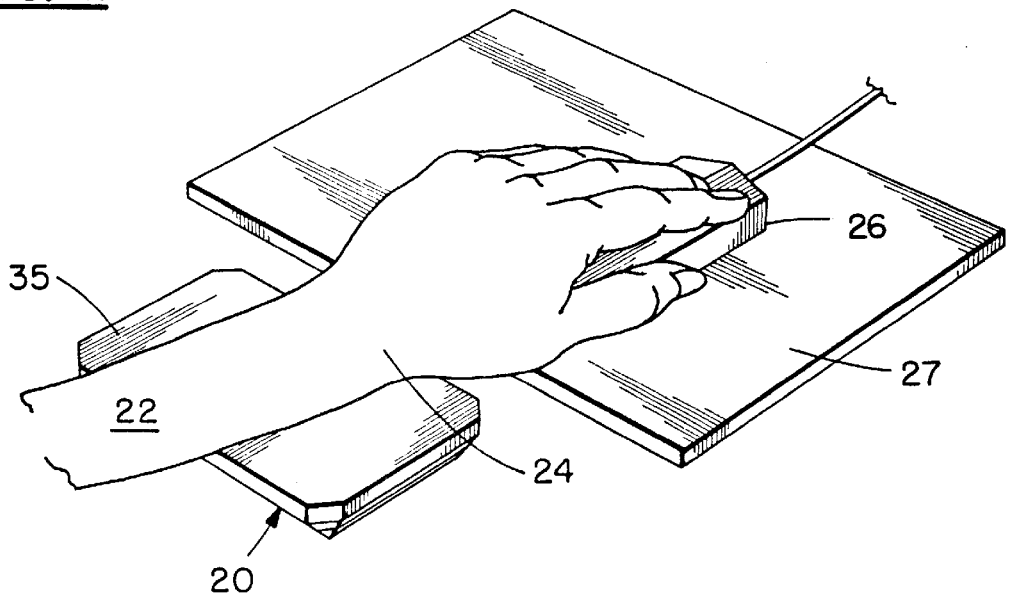
FIG. 1 is a perspective view illustrating the use of the ergonomic support pad of the invention.
Figure 2:
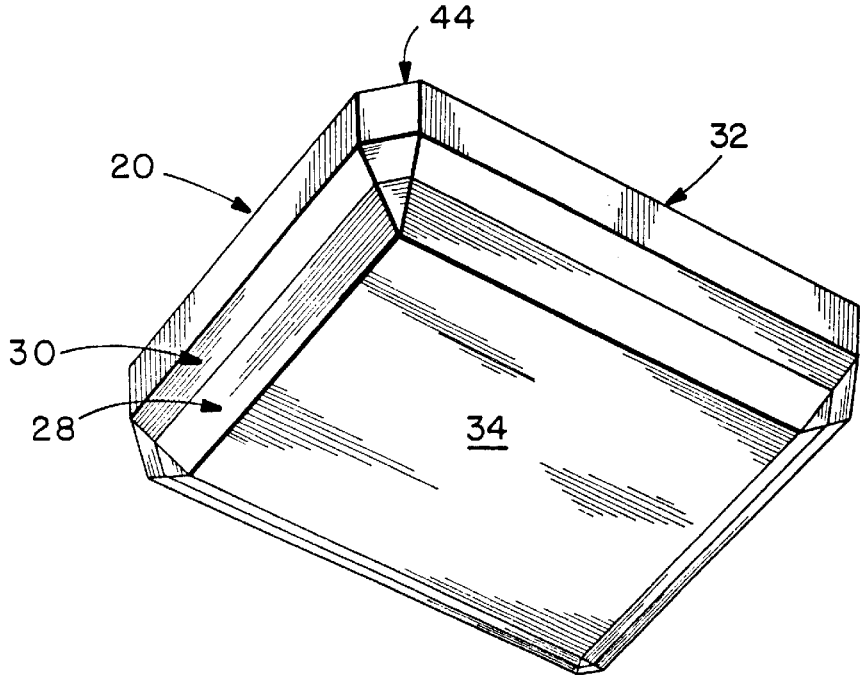
FIG. 2 is a perspective view illustrating only the ergonomic support pad of the invention.
Figure 4:
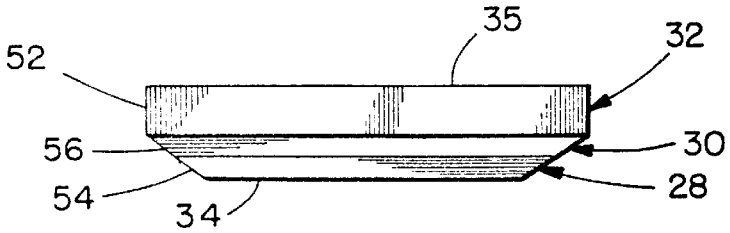
FIG. 4 is a side elevation view of a preferred construction of the ergonomic support pad of the invention.
Figure 3:
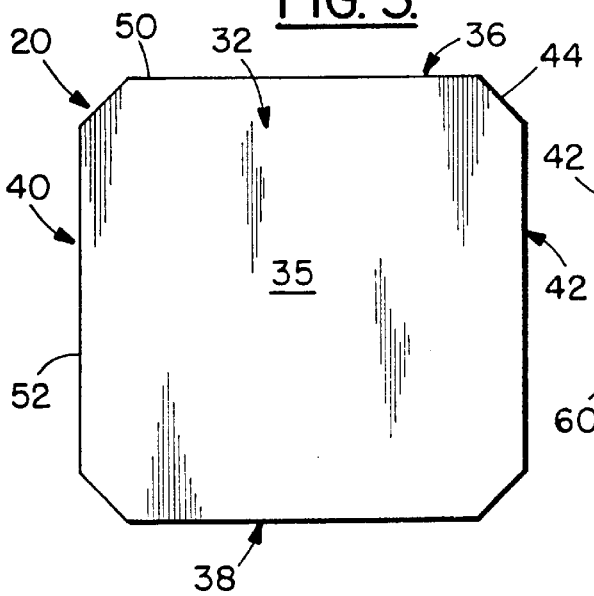
FIG. 3 is a top plan view of the ergonomic support pad of the invention.
Figure 5:
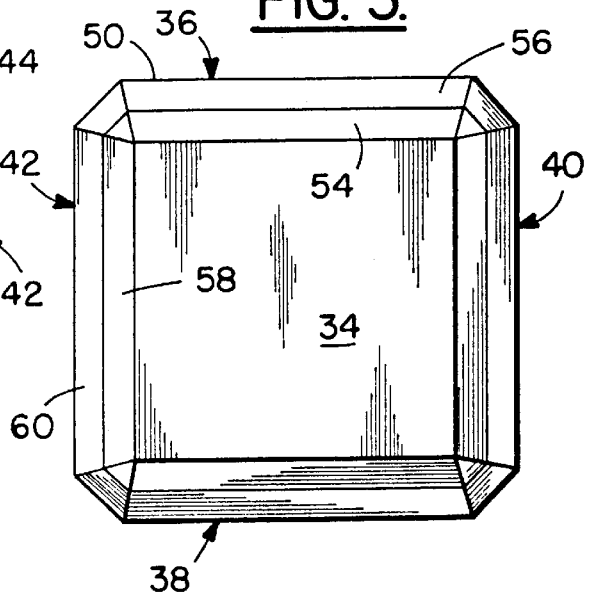
FIG. 5 is a bottom plan view of the ergonomic support pad of the invention.

Turn now to the drawings and, initially, to FIG. 1 which generally illustrates an ergonomic support pad 20 for receiving and supporting the forearm 22 and wrist 24 of a person operating an input-output device 26 for a computer (not shown). The input-output device 26 may be a mouse which is selectively movable across the surface of a mouse pad 27 which customarily has an upper surface with a relatively high coefficient of friction for engagement with the ball or roller of the mouse. As more particularly seen in FIGS. 2, 3, 4, and 5, the support pad 20 comprises bottom, middle, and top layers 28, 30, and 32, respectively, of plastic foam material. The plastic foam material is open celled polyurethane foam material, preferably of the type which softens on contact with a warm surface thereby providing uniform pressure distribution and firm, yet fluid, support. A suitable material for purposes of the invention is a product manufactured under the name of CONFOR™ Ergonomic Urethane Foams by E•A•R Specialty Composites Division, Cabot Safety Corporation of Indianapolis, Ind.

Open celled foam material suitable for purposes of the invention is breathable, non-irritating in dermal contact, and helps dissipate moisture and perspiration away from the body of the user. Each of the layers is of substantially uniform thickness. The bottom layer 28 has a bottom surface 34 for resting on a supporting surface. The top layer 32 is exposed and has a top surface 35 adapted for engageably receiving the forearm 22 and wrist 24 of the person operating the input-output device. The middle layer 30 is intermediate and sandwiched between the bottom layer 28 and the top layer 32.

Each of the layers exhibits an indentation force deflection, as measured by ASTM D3574 Test B1. After performing a substantial investigation, preferred indentation force deflections for the support pad 20 have been determined to be, respectively, for the bottom layer 28: in the approximate range of 488 lbf @10° C., 27 lbf @21° C. and 9 lbf @38° C.; for the middle layer 30: in the approximate range of 315 lbf @10° C., 10 lbf @21° C. and 7 lbf @38° C.; and for the top layer 32: in the approximate range of 34 lbf @10° C., 4 lbf @21° C. and 3 lbf @38° C. The ergonomic support pad 20 preferably has a total thickness in the approximate range of one to two inches.

Figure 6:
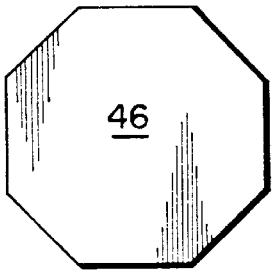
FIG. 6 is a top plan view of another embodiment of the ergonomic support pad of the invention.
Figure 7:
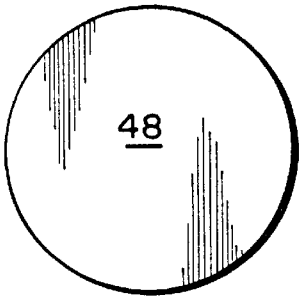
FIG. 7 is a top plan view of still another embodiment of the ergonomic support pad of the invention.

As seen in FIGS. 2–5, the support pad 20 is of substantially quadrilateral shape (see FIG. 3) as seen in plan view having first and second opposed longitudinal surfaces 36, 38, respectively, and first and second opposed lateral surfaces 40, 42 and four corner surfaces 44 being biased and joining, respectively, adjoining pairs of the longitudinal and lateral surfaces. It will be appreciated that the quadrilateral shape may actually be one of a variety of possible shapes including squares, rectangles, and parallelograms. Of course any number of other shapes are also possible, polygonal as indicated by a modified support pad 46 (FIG. 6) and circular as indicated by a modified support pad 48 (FIG. 7).

Returning to FIGS. 2–5, it was earlier mentioned that the support pad 20 has first and second opposed longitudinal edge surfaces 36, 38 and first and second opposed lateral edge surfaces 40, 42 which extend, respectively, from the bottom surface 34 to the top surface 35. As seen particularly well in FIGS. 3 and 4, opposed longitudinal edge surfaces 50 and opposed lateral edge surfaces 52, respectively, of the top layer 32 lie in planes which are substantially perpendicular to the top surface 35. Opposed longitudinal edge surfaces 54, 56 of the middle and bottom layers, 30 and 28, respectively, are uniformly angularly disposed with respect to the bottom surface 34. In similar fashion, opposed lateral edge surfaces 58, 60 of the middle and bottom layers 30, 28, respectively, are uniformly angularly disposed with respect to the bottom surface. The area of the bottom surface 34 is smaller than the area of the top surface 35.

A construction for the support pad 20 resulting in a particularly desirable ergonomic effect has been found to occur when the combined thicknesses of the bottom layer 28 and of the middle layer 30 are approximately equal to the thickness of the top layer 32.

Figure 8:
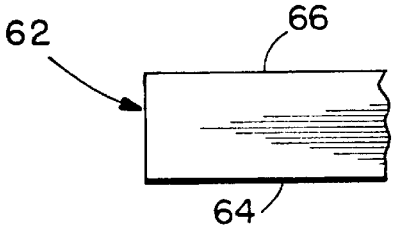
FIGS. 8, 9, and 10 are detail side elevation views, respectively, of still other embodiments of the ergonomic support pad of the invention.

Still another embodiment of the invention is illustrated in FIG. 8 which depicts a modified support pad 62. In the instance illustrated, the support pad has only a single layer of plastic foam material and that single layer has a bottom surface 64 for resting on a supporting surface and a top surface 66 adapted for engageably receiving the forearm 22 and wrist 24 of a person. In this instance, the single layer exhibits a continuous gradient of values of indentation force deflections, as measured by ASIM D3574 Test B1, which are, respectively, adjacent the bottom surface: in the approximate range of 488 lbf @10° C., 27 lbf @21° C. and 9 lbf @38° C., and adjacent the top surface: in the approximate range of 34 lbf @10° C., 4 lbf @21° C. and 3 lbf @38° C., the ergonomic support pad having a total thickness in the approximate range of one to two inches.

Figure 9:
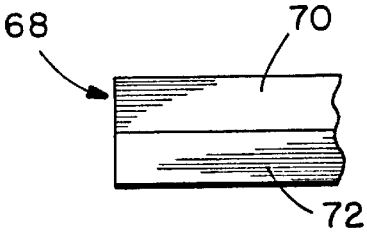

FIG. 9 is similar to FIG. 8 but illustrates a pair of layers 70, 72 suitably bonded together and each exhibits a continuous gradient of values of indentation force deflections.

Figure 11:
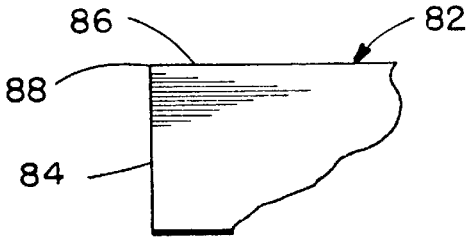
FIG. 11 is a detail top plan view of still another embodiment of the ergonomic support pad of the invention.
Figure 10:
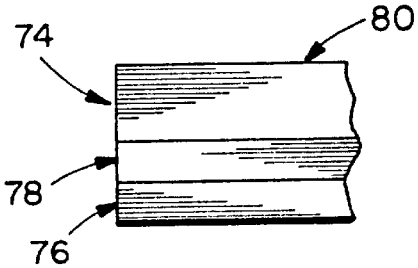

Also, it is preferred that the support pad 20 be peripherally undercut as indicated by the longitudinal edge surfaces 54, 56 and by the lateral edge surfaces 58, 60, previously described. However, viewing FIG. 10, it may be desirable for certain applications that a modified support pad 74 having bottom, middle, and top layers, 76, 78, 80, respectively, be constructed without any such undercut. Similarly, another modified support pad 82 (FIG. 11) does not have corner surfaces 44 on the bias. Rather, adjacent lateral and longitudinal surfaces, 84, 86, respectively, meet at a corner 88.

Figure 12:
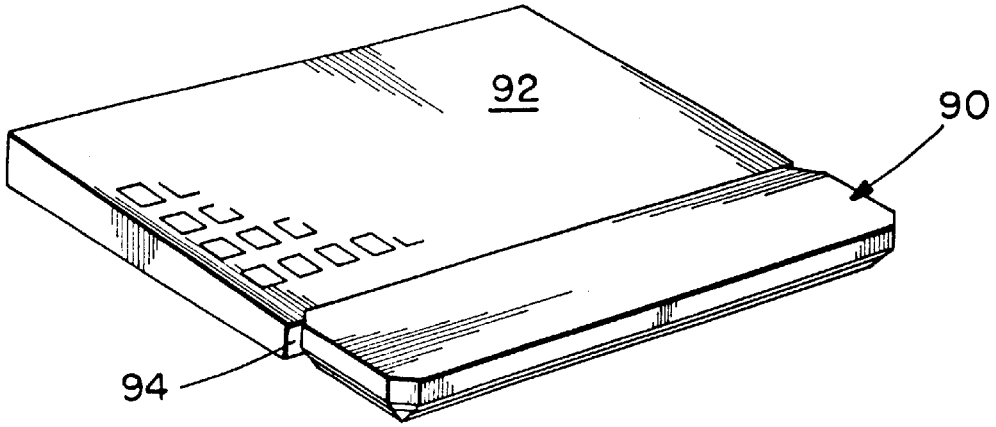
FIG. 12 is a perspective view illustrating a modified support pad provided for use in association with a keyboard.
Figure 13:
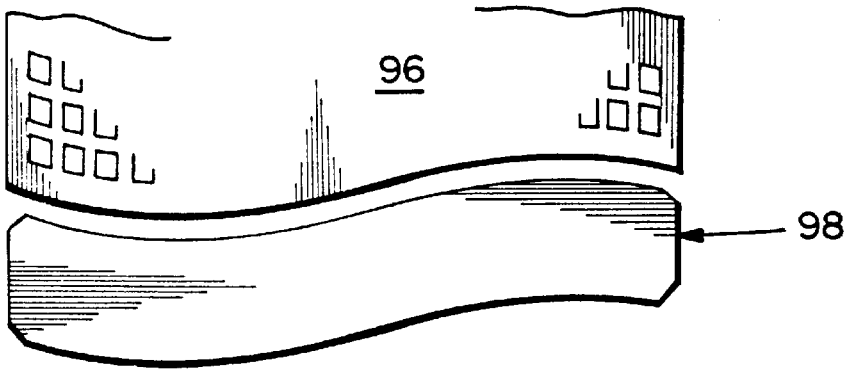
FIG. 13 is a top plan view of a further modified support pad provided for use in association with a keyboard having an irregular shape which is other than rectangular.

It will further be appreciated that the support pad of the invention need not be limited to an input-output device 26 in the nature of a mouse. As seen in FIG. 12, a modified support pad 90 may be provided for use in association, for example, with a keyboard 92 and, for this purpose, would be aligned and in close proximity with and coextensive with a front edge 94 of the keyboard. Additionally, many modern keyboards have irregular shapes, as seen in plan view, that is, other than rectangular. In the instance of a keyboard 96 of such irregular shape, as seen in FIG. 13, it would be desirable to provide a further modified support pad 98 which would be shaped appropriately accordingly.

The foregoing portion of this detailed description has presented the specifics of the invention disclosed in the earlier mentioned co-pending application of the applicant. Experiences with the concepts just described have led to a number of new embodiments of the basic which will new be described. It came to be realized that an earlier unrecognized function of the relatively firm bottom layer 28 of the support pad 20, for example, resides in restraining excess movement of the middle layer 30 and, especially, the top layer 32 in outward directions, that is, longitudinally and laterally, generally in the plane of the support pad when it receives thereon the weight of the user's forearm and/or wrist. At the same time, while the multiple layered construction of the support pad 20 is a highly desirable one which well serves its intended purpose, it was deemed desirable to simplify the construction while retaining the substantial benefits already achieved.

Figure 14:
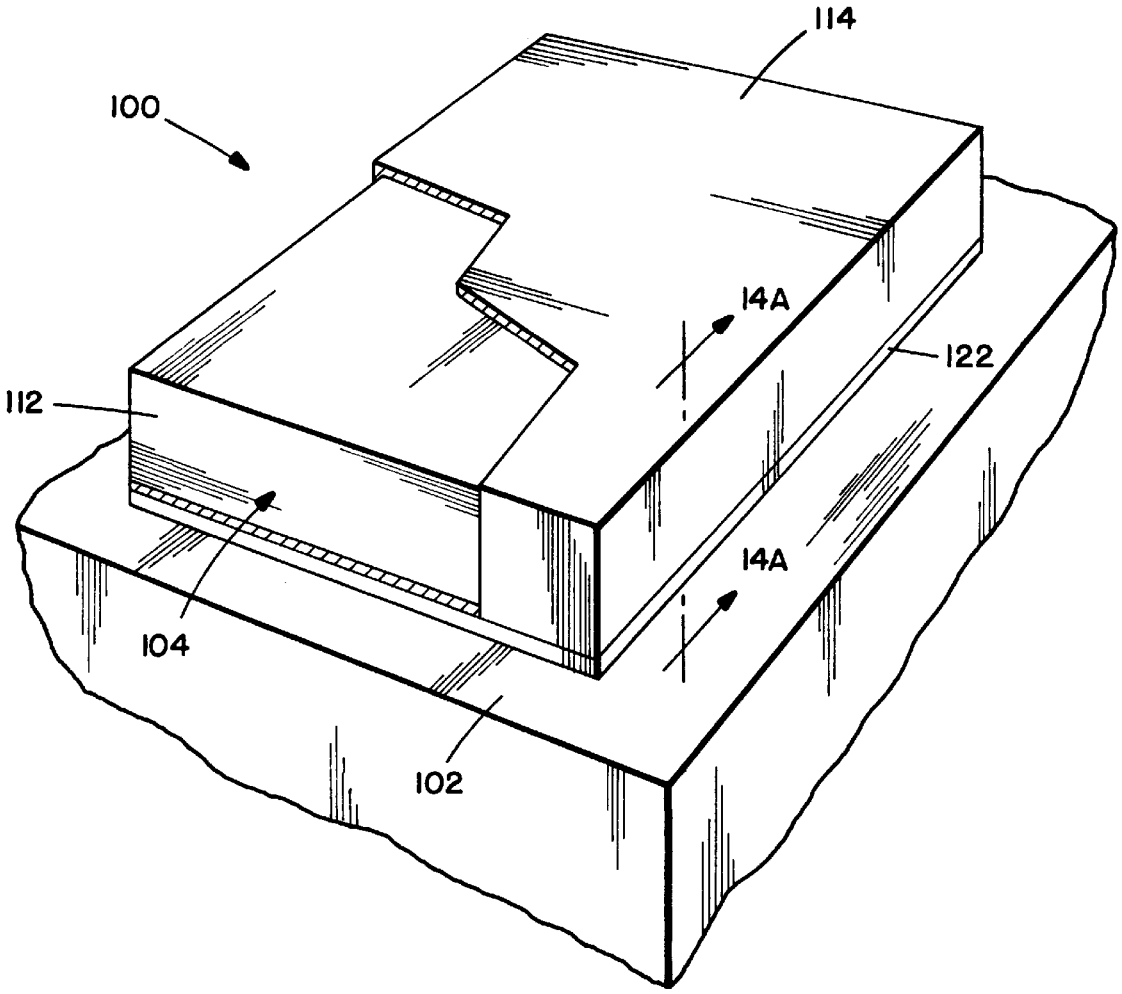
FIG. 14 is a perspective view of yet another embodiment of the invention, certain parts being cut away and illustrated in section.

It is to this end that an improved ergonomic support system 100 for receiving and supporting the forearm 22 and/or wrist 24 of a person engaged in an activity on a supporting surface 102 has been devised. Viewing FIGS. 14 and 14A, in this instance, a support member 104 of plastic foam material extends in a generally planar configuration, that is, longitudinally and laterally, and has a bottom surface 106 for resting on the supporting surface 102 and a top surface 108 adapted for receiving the forearm and/or wrist of the user. The support member 104 is also defined by a transverse dimension 110, or thickness, as measured between the top surface 108 and the bottom surface 106 and has a surface 112 extending peripherally between the top surface and the bottom surface. The support member 104 exhibits a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C. and, as in the earlier described embodiments, and has a total thickness in the range of about one to two inches.

The plastic foam material for the support member 104, as with the earlier embodiments, is open celled polyurethane foam material, preferably of the type which softens on contact with a warm surface thereby providing uniform pressure distribution and firm, yet fluid, support. A suitable material for purposes of the support system 100 is the product, previously mentioned, manufactured under the name of CONFOR™ Ergonomic Urethane Foams by E•A•R Specialty Composites Division, Cabot Safety Corporation of Indianapolis, Ind.

Figure 15:
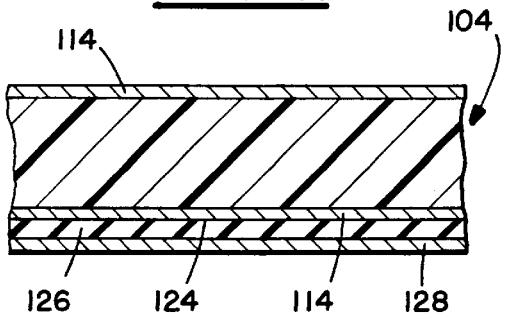
FIGS. 15 through 19 are detail cross section views of still other embodiments, respectively, of the invention.

However, essential for the operation of this embodiment of the invention is an outer covering 114 of substantially taut flexible material enveloping the support member 104 contiguous to the bottom surface 106, to the top surface 108, and to the peripheral surface 112 to restrain against longitudinal and lateral displacement of the plastic foam material when applying a transverse force to the support member. A particularly desirable material for purposes of the invention is LYCRA® brand blend fabric manufactured by E.I. DuPont de Nemours Company of Wilmington, Del. although unadulterated cotton fabric and other materials would also well serve the purpose of the invention. In the event a stretchable material is used having the nature of LYCRA® brand material, it should be stretched taut when it envelops the support member 104 so that it firmly covers and retains the desired configuration of the support member, but must not be over-taut such that it would cause the opposite ends of the support member undesirably to curl. The support member 104 may have a rubberized layer 122 suitably attached to a lower surface 124 of the outer covering 114 to prevent it from sliding across the supporting surface 102. In another instance of the invention as seen in FIG. 15, an adhesive layer 126 is provided overlying the lower surface 124 of the outer covering 114, again to prevent sliding movement of the support system on the supporting surface. Thereupon, a peel sheet 128 is temporarily bonded to the adhesive layer 126 for its protection but is selectively removable to expose the adhesive layer when it is desired to mount the support system for use.

Figure 14B:
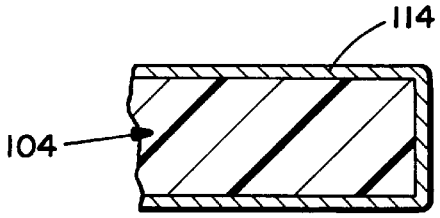
FIGS. 14B and 14C are detail cross section views of still further embodiments, respectively, of the invention.
Figure 14C:
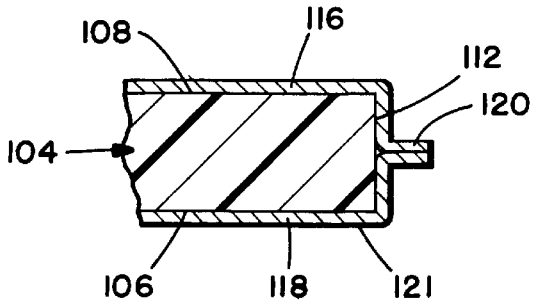

The outer covering 114 may be continuous (see FIG. 14B) as may be achieved with a heat-sealed seam, for example, if it is of a polymeric material. In the alternative, as seen in FIG. 14C, an outer covering may be discontinuous, including a first sheet 116 of flexible material having a relatively low coefficient of friction and a second sheet 118 of flexible material having a relatively high coefficient of friction. Indeed, the second sheet 118 may be rubberized or of rubber-like material, with the first and second sheets being joined, as by sewing, along a seam 120 proximate the peripheral surface 112 and intermediate the top and bottom surfaces 108, 106. In this manner, the outer covering's second sheet 118 has a lower surface 121, adjacent the bottom surface 106 of the support member 104, which is so fashioned as to prevent sliding movement of the support system 100 on the supporting surface.

Figure 14A:
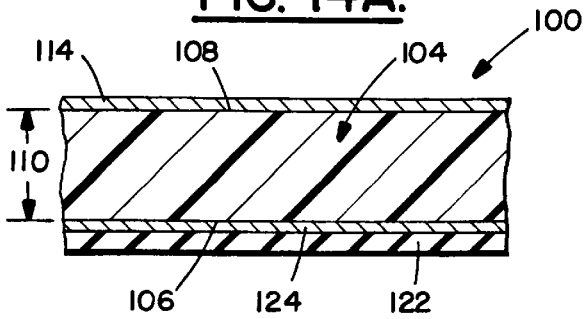
FIG. 14A is a detail cross section view taken generally along line 14A—14A in FIG. 14.

Just as in the embodiments of FIGS. 14A and 15 a support system may have a rubberized or an adhesive-layered undersurface, the embodiment of FIG. 14C may be similarly featured.

In another instance of the invention as seen in FIG. 15, an adhesive layer 126 is provided overlying the lower surface 124 of the outer covering 114, again to prevent sliding movement of the support system on the supporting surface. Thereupon, a peel sheet 128 is temporarily bonded to the adhesive layer 126 for its protection but is selectively removable to expose the adhesive layer when it is desired to mount the support system for use.

Figure 16:
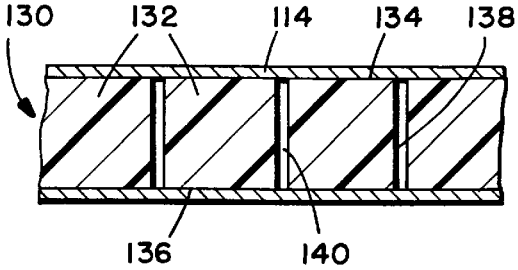

In another instance of the invention, viewing FIG. 16, a modified support member 130 is discontinuous and has a plurality of cell members 132. Each of the cell members 132 extends between top and bottom surfaces 134, 136, respectively and is further defined by transverse sidewalls 138. The sidewalls of adjacent cell members are substantially parallel and spaced apart by a distance in the range of about 1/32 inch to about ¼ inch to form gaps therebetween. The gaps 140 are air-filled and are, therefore, heat barriers such that the heat from the user's wrist and/or forearm is concentrated only in the immediate region of its presence on the support system and is not dissipated through adjacent and/or distant cell members 132. In this manner, a support system incorporating the support member 130 can more effectively localize the heat from the user's body, thereby softening the heat sensitive foam material, enabling it to comfortably conform to the body of the user.

Figure 17:
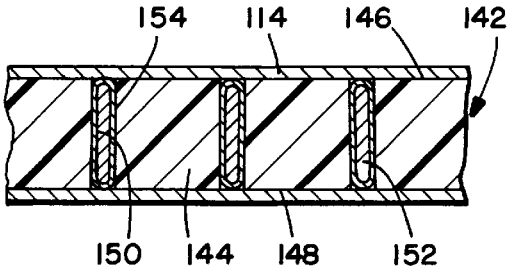

In still another instance of the invention, turning now to FIG. 17, a modified support member 142 is again discontinuous, having a plurality of cell members 144, each of the cell members extending between top and bottom surfaces, 146, 148, respectively. Again, the cell members 144 are defined by transverse sidewalls 150. As in the instance of the support member 130, the sidewalls 150 of adjacent cell members 144 are substantially parallel and the cell members may be uniformly or randomly spaced apart. However, in this instance, the gaps between the adjacent cell members 144 are filled with thermally insulative material. More specifically, the gaps between the adjacent cell members are filled with a suitable gel material 152 of a type which is thermally insulative and contained within sealed capsules 154. The benefits provided by the support member 142 (FIG. 17) would be similar to those provided by the support member 130 (FIG. 16), but enhanced because of the ability of the former to keep the sidewalls 150 separated while there is no structure in the latter to keep the sidewalls 138 separated.

Figure 18:
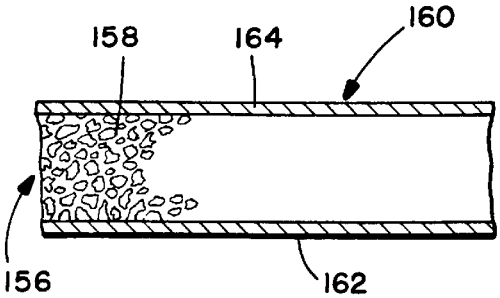

In still another instance of the invention, turning now to FIG. 18, a modified support member 156 of plastic foam material 158 is provided in particulate form with particle size distribution in the approximate range of 1/16 inch to 1 inch across. The plastic foam material 158 exhibits a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C. and is preferably composed of open celled polyurethane material of the type which softens on contact with a warm surface thereby providing uniform pressure distribution and firm, yet fluid, support of the person's arm and wrist.

An outer covering 160 of substantially taut flexible material envelops the support member to contain the particulate plastic foam material in a compressed state. As in the previously described embodiments, the outer covering 160 has a bottom surface 162 for resting on a supporting surface and a top surface 164 adapted for receiving the forearm and/or wrist of the user. The resulting construction provides restraint against lateral displacement of the plastic foam material when a force is applied to the top surface 164. The support member has a total thickness in the approximate range of one to two inches. Also as in the previously described embodiments, the outer covering 160 of the support system of the FIG. 18 embodiment may be continuous or it may be discontinuous, including a first sheet of flexible material having a relatively low coefficient of friction and a second sheet of flexible material having a relatively high coefficient of friction with the first and second sheets being joined along a seam proximate the peripheral surface and intermediate the top and bottom surfaces.

Figure 19:
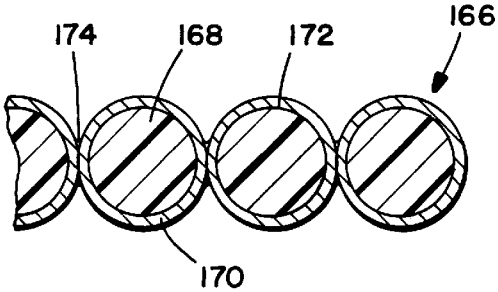

In still another instance of the invention, turning now to FIG. 19, a modified ergonomic support system 166 includes a plurality of elongated support members 168, each of plastic foam material exhibiting a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C. More specifically, the support members 168 are composed of open celled polyurethane material of the type which softens on contact with a warm surface thereby providing uniform pressure distribution and firm, yet fluid, support of the person's arm and wrist. The support members 166 may be of any desired cross sectional shape, regular or irregular. Each of the support members 168 has an enveloping outer covering 170 of substantially taut flexible material contiguous to its outer peripheral surface 172 to restrain against longitudinal and lateral displacement of the plastic foam material when applying a transversely directed force to the support system. In this instance, the plurality of the support members 168 are positioned in substantially parallel side by side relationship and the outer coverings 170 of the adjacent support members are joined as by adhesive 174 or by sewing or in some other suitable manner, resulting in the unified ergonomic support system 166. The support system 166 has a total thickness in the approximate range of one to two inches.

Figure 20:
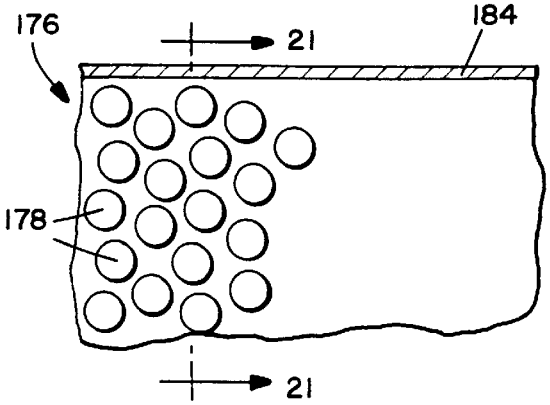
FIG. 20 is a plan view, partially cut away and shown in section, of yet another embodiment of the invention.
Figure 21:
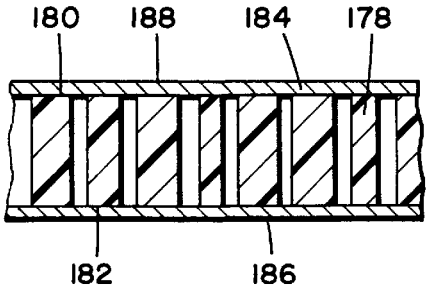
FIG. 21 is a detail cross section view taken generally along line 21—21 in FIG. 21.

In yet a further instance of the invention, turning now to FIGS. 20 and 21, a modified ergonomic support system 176 includes a plurality of longitudinally and laterally spaced cylindrical cell members 178, each of which extends between top and bottom surfaces 180, 182. The cell members 178, which may be of other than circular cross sectional shape, may be uniformly or randomly spaced and are composed of open celled polyurethane material of the type which softens on contact with a warm surface thereby providing uniform pressure distribution and firm, yet fluid, support of the user's arm and wrist. Also as in the previously described embodiments, an outer covering 184 of substantially taut flexible material envelops the cell members 178. Also as in the previously described embodiments, the outer covering 184 has a bottom surface 186 for resting on a supporting surface and a top surface 188 adapted for receiving the forearm and/or wrist of the user. The resulting construction provides restraint against lateral displacement of the plastic foam material when a force is applied to the top surface 188. Again, the support system 176 has a total thickness in the approximate range of one to two inches. Also as in the previously described embodiments, the outer covering 184 may be continuous or it may be discontinuous, including a first sheet of flexible material having a relatively low coefficient of friction and a second sheet of flexible material having a relatively high coefficient of friction with the first and second sheets being joined along a seam proximate the peripheral surface and intermediate the top and bottom surfaces.

Figure 22:
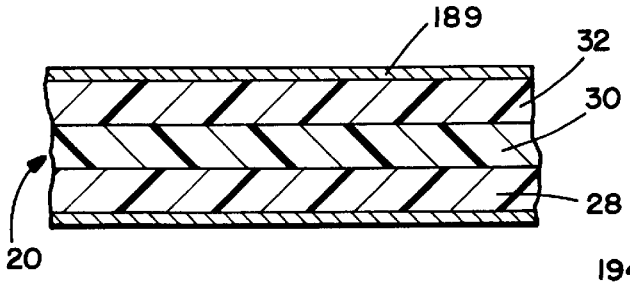
FIGS. 22 and 23 are detail cross section views of yet further embodiments, respectively, of the invention.

In still another instance of the invention, turning now to FIG. 22, the support pad 20 including the bottom, middle, and top layers 28, 30, 32, respectively, of the plastic foam material is enveloped by an outer covering 189 of substantially taut flexible material contiguous to the bottom surface 34, the top surface 35, and the peripheral surfaces 36, 38, 40, 42, and 44 to further restrain against lateral displacement of the plastic foam material, particularly the top layer 32 when a force is applied to the top surface 35.

Figure 23:
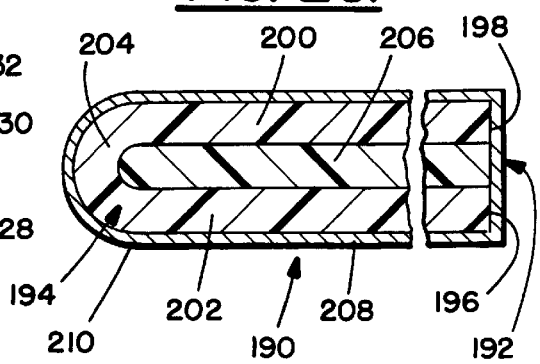

In a final instance of the invention, turning now to FIG. 23, an ergonomic support system 190 comprises a support member 192 of the plastic foam material which includes a first elongated member 194 initially having first and second spaced apart ends, 196, 198, respectively. The first elongated member 194 is manipulated so that the second end 198 overlies the first end 196 and thereby forms an upper leg 200 and a lower leg 202 connected at a bight 204 distant from the first and second ends. A second elongated member 206 is interposed between the upper and lower legs, 200, 202 and adjacent the bight 204 and the first and second elongated members 194, 206 exhibit indentation force deflections, as measured by ASTM D3574 Test B1, which are, respectively, for the first elongated member: in the approximate range of 34 lbf @10° C., 4 lbf @21° C. and 3 lbf @38° C., and for the second elongated member: in the approximate range of 315 lbf @10° C., 10 lbf @21° C. and 7 lbf @38° C. An outer covering 208 of substantially taut flexible material fully envelops the support member 192 contiguous to the upper and lower legs, 200, 202, the bight 204, and the first and second ends 196, 198 to restrain against lateral displacement of the plastic foam material when applying a force in the direction of a supporting surface 210. As in the previous embodiments, the support member 192 is composed of open celled polyurethane material of the type which softens on contact with a warm surface thereby providing uniform pressure distribution and firm, yet fluid, support of the user's arm and wrist.

The contour provided at the end of the bight 204 of the support system 190 is reminiscent of the undercut edge surfaces 54, 65, 58, and 60 of the support pad 20 with the attendant benefits thereby achieved as previously described.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. An ergonomic support system for receiving and supporting at least one of the forearm and wrist of a person engaged in an activity on a supporting surface comprising:

a support member of plastic foam material extending longitudinally and laterally and having a bottom surface for resting on the supporting surface, a top surface adapted for receiving at least one of the forearm and wrist of the person, a transverse dimension as measured between said top surface and said bottom surface, and a peripheral surface extending between said top surface and said bottom surface, said support member exhibiting a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C., said support member having a total thickness in the approximate range of one to two inches; and an outer covering of substantially taut flexible material enveloping said support member contiguous to the bottom, top, and peripheral surfaces to restrain against longitudinal and lateral displacement of the plastic foam material when applying a transverse force to said support system.

2. The ergonomic support system as set forth in claim 1 wherein said outer covering is continuous.

3. The ergonomic support system as set forth in claim 1 wherein said outer covering is discontinuous, including a first sheet of flexible material having a relatively low coefficient of friction and a second sheet of flexible material having a relatively high coefficient of friction, said first and second sheets being joined along a seam proximate said peripheral surface and intermediate said top and bottom surfaces.

4. The ergonomic support system as set forth in claim 1 wherein said support member is composed of open celled polyurethane material.

5. The ergonomic support system as set forth in claim 1 wherein said support member is composed of open celled polyurethane material of the type which softens on contact with a warm surface thereby providing uniform pressure distribution and firm, yet fluid, support of the person's arm and wrist.

6. The ergonomic support system as set forth in claim 1 wherein said support member is discontinuous having a plurality of cell members, each of said cell members extending between said top and bottom surfaces and defined by transverse sidewalls, said sidewalls of adjacent cell members being substantially parallel and spaced apart by a distance in the range of about 1/32 inch to about 1/4 inch to form gaps therebetween.

7. The ergonomic support system as set forth in claim 1 wherein said support member is discontinuous having a plurality of cell members, each of said cell members extending between said top and bottom surfaces and defined by transverse sidewalls, said sidewalls of adjacent cell members being substantially parallel and randomly spaced apart.

8. The ergonomic support system as set forth in claim 1 wherein said support member is discontinuous having a plurality of longitudinally and laterally spaced cylindrical cell members, each of said cell members extending between said top and bottom surfaces.

9. The ergonomic support system as set forth in claim 6 wherein the gaps between said adjacent cell members are filled with thermally insulative material.

10. The ergonomic support system as set forth in claim 6 wherein the gaps between said adjacent cell members are filled with encapsulated gel material.

11. The ergonomic support system as set forth in claim 1 wherein said outer covering has a lower surface adjacent said bottom surface of said support member, said lower surface being rubberized to prevent sliding movement of said support system on the supporting surface.

12. The ergonomic support system as set forth in claim 1 wherein said outer covering has a lower surface adjacent said bottom surface of said support member; and including:

an adhesive layer overlying the lower surface to prevent sliding movement of the support system on the supporting surface; and a peel sheet temporarily bonded to the adhesive layer for protection of the adhesive layer but selectively removable to expose the adhesive layer.

13. An ergonomic support system for receiving and supporting at least one of the forearm and wrist of a person engaged in an activity on a supporting surface comprising:

a support member including bottom, middle, and top layers of plastic foam material, each of said layers being of substantially uniform thickness, said bottom layer having a bottom surface for resting on a supporting surface, said top layer being exposed and having a top surface adapted for engageably receiving the forearm and wrist of the person, said middle layer being intermediate and sandwiched between said bottom layer and said top layer, and a peripheral surface on each of said layers and extending between said top surface and said bottom surface, said layers exhibiting indentation force deflections, as measured by ASTM D3574 Test B1, which are, respectively, for said bottom layer: in the approximate range of 488 lbf @10° C., 27 lbf @21° C. and 9 lbf @38° C., for said middle layer: in the approximate range of 315 lbf @10° C., 10 lbf @21° C. and 7 lbf @38° C., and for said top layer: in the approximate range of 34 lbf @10° C., 4 lbf @21° C. and 3 lbf @38° C., said ergonomic support pad having a total thickness in the approximate range of one to two inches; and an outer covering of substantially taut flexible material enveloping said support member contiguous to said bottom, top, and peripheral surfaces to restrain against lateral displacement of said plastic foam material when applying a transverse force to said support system.

14. The ergonomic support system as set forth in claim 13 being composed of open celled polyurethane material.

15. The ergonomic support system as set forth in claim 13 being composed of open celled polyurethane material of the type which softens on contact with a warm surface thereby providing uniform pressure distribution and firm, yet fluid, support of the person's arm and wrist.

16. An ergonomic support system for receiving and supporting at least one of the forearm and wrist of a person engaged in an activity on a supporting surface comprising:

a support member of plastic foam material exhibiting a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C., said plastic foam material being in particulate form with particle size distribution in the approximate range of 1/16 inch to 1 inch across; and an outer covering of substantially taut flexible material enveloping said support member to contain said particulate plastic foam material in a compressed composition, said outer covering having a bottom surface for resting on the supporting surface and a top surface adapted for receiving the forearm and/or wrist of the person and restraining against lateral displacement of said plastic foam material when applying a transverse force to said support system, said support member having a total thickness in the approximate range of one to two inches.

17. The ergonomic support system as set forth in claim 16 wherein said outer covering is continuous.

18. The ergonomic support system as set forth in claim 16 wherein said outer covering is discontinuous, including a first sheet of flexible material having a relatively low coefficient of friction and a second sheet of flexible material having a relatively high coefficient of friction, said first and second sheets being joined along a seam proximate said peripheral surface and intermediate said top and bottom surfaces.

19. The ergonomic support system as set forth in claim 16 wherein said support member is composed of open celled polyurethane material of the type which softens on contact with a warm surface thereby providing uniform pressure distribution and firm, yet fluid, support of the person's arm and wrist.

20. An ergonomic support system for receiving and supporting at least one of the forearm and wrist of a person engaged in an activity on a supporting surface comprising:

a plurality of elongated support members of plastic foam material exhibiting a substantially uniform value of indentation force deflection, as measured by ASTM D3574 Test B1, which is in the approximate ranges of 488 lbf to 34 lbf @10° C., 27 lbf to 4 lbf @21° C. and 9 lbf to 3 lbf @38° C., each said support member having an outer peripheral surface;

each of said support members having an outer covering of substantially taut flexible material enveloping said support member contiguous to said outer peripheral surface to restrain against lateral displacement of the plastic foam material when applying a force transverse thereto, said support member having a total thickness in the approximate range of one to two inches;

said support members being in substantially parallel side by side relationship, the outer coverings of adjacent ones of said support members being joined and resulting in a unified ergonomic support system.

21. The ergonomic support system as set forth in claim 20 wherein said support member is composed of open celled polyurethane material of the type which softens on contact with a warm surface thereby providing uniform pressure distribution and firm, yet fluid, support of the person's arm and wrist.

22. An ergonomic support system for receiving and supporting at least one of the forearm and wrist of a person engaged in an activity on a supporting surface comprising:

a support member of plastic foam material including a first elongated member initially having first and second spaced apart ends, said first elongated member being manipulated so that the second end overlies the first end and thereby forming an upper leg and a lower leg connected at a bight distant from the first and second ends; a second elongated member interposed between the upper and lower legs, said first and second elongated members exhibiting indentation force deflections, as measured by ASTM D3574 Test B1, which are, respectively, for said first elongated member: in the approximate range of 34 lbf @10° C., 4 lbf @21° C. and 3 lbf @38° C., and for said second elongated member: in the approximate range of 315 lbf @10° C., 10 lbf @21° C. and 7 lbf @38° C.; and an outer covering of substantially taut flexible material enveloping the support member contiguous to said upper and lower legs, said bight, and said first and second ends to restrain against lateral displacement of said plastic foam material when applying a force in the direction of said supporting surface.

23. The ergonomic support system as set forth in claim 22 wherein said support member is composed of open celled polyurethane material of the type which softens on contact with a warm surface thereby providing uniform pressure distribution and firm, yet fluid, support of the person's arm and wrist.

24. The ergonomic support system as set forth in claim 22 wherein said outer covering has a lower surface adjacent said bottom surface of said support member, said lower surface being rubberized to prevent sliding movement of the support system on said supporting surface.

25. The ergonomic support system as set forth in claim 22 wherein said outer covering has a lower surface adjacent the bottom surface of said support member; and including:

an adhesive layer overlying said lower surface to prevent sliding movement of said support system on the supporting surface; and a peel sheet temporarily bonded to said adhesive layer for its protection but selectively removable to expose said adhesive layer.

* * * * *